US011808465B2

(12) United States Patent
Adachi et al.

(10) Patent No.: US 11,808,465 B2
(45) Date of Patent: Nov. 7, 2023

(54) OUTDOOR UNIT OF AIR CONDITIONING APPARATUS

(71) Applicant: Mitsubishi Electric Corporation, Tokyo (JP)

(72) Inventors: Naho Adachi, Tokyo (JP); Takahide Tadokoro, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 41 days.

(21) Appl. No.: 17/635,440

(22) PCT Filed: Oct. 26, 2020

(86) PCT No.: PCT/JP2020/040099

§ 371 (c)(1),
(2) Date: Feb. 15, 2022

(87) PCT Pub. No.: WO2021/085377

PCT Pub. Date: May 6, 2021

(65) Prior Publication Data

US 2022/0333794 A1 Oct. 20, 2022

(30) Foreign Application Priority Data

Oct. 29, 2019 (WO) ..... PCT/JP2019/042324

(51) Int. Cl.
*F24F 1/38* (2011.01)
*F24F 1/18* (2011.01)

(52) U.S. Cl.
CPC . *F24F 1/38* (2013.01); *F24F 1/18* (2013.01)

(58) Field of Classification Search
CPC ..... F24F 1/18; F24F 1/38
See application file for complete search history.

(56) References Cited

U.S. PATENT DOCUMENTS

2010/0269537 A1* 10/2010 Tadokoro ..... F24F 1/16 62/426
2011/0127019 A1 6/2011 Abastari et al.
(Continued)

FOREIGN PATENT DOCUMENTS

CN 101925783 A 12/2010
CN 103097821 A 5/2013
(Continued)

OTHER PUBLICATIONS

Extended European Search Report dated Nov. 11, 2022 issued in corresponding EP Patent Application No. 20880775.0.
(Continued)

*Primary Examiner* — Schyler S Sanks
(74) *Attorney, Agent, or Firm* — POSZ LAW GROUP, PLC

(57) ABSTRACT

An outdoor unit of an air-conditioning apparatus includes a bell mouth that has a first tapered portion and a straight pipe portion. The first tapered portion has a linking portion that is continuous with a first bent portion and a second bent portion in a region located between the first and second bent portions and that has an inner surface extending linearly. The angle of inclination of the inner surface of the linking portion relative to a direction along an axis of the straight pipe portion is 33 degrees or more. The ratio of the sum of a first length of the first tapered portion and a second length of the straight pipe portion to the total length of the bell mouth is less than 0.76.

6 Claims, 5 Drawing Sheets

(56) References Cited

U.S. PATENT DOCUMENTS

| | | | |
|---|---|---|---|
| 2011/0192186 | A1 | 8/2011 | Kato et al. |
| 2013/0125579 | A1 | 5/2013 | Okazawa |

FOREIGN PATENT DOCUMENTS

| | | | |
|---|---|---|---|
| EP | 2 233 847 | A1 | 9/2010 |
| JP | 2006077585 | A | 3/2006 |
| JP | 2010-112204 | A | 5/2010 |
| JP | 2010-236372 | A | 10/2010 |
| JP | 2011-111998 | A | 6/2011 |
| JP | 2013-096622 | A | 5/2013 |
| JP | 5322900 | B | 10/2013 |
| JP | 2018-168764 | A | 11/2018 |
| WO | 2009113338 | A1 | 9/2009 |
| WO | 2012035577 | A1 | 3/2012 |

OTHER PUBLICATIONS

Examination Report dated Sep. 19, 2022 issued in corresponding IN Patent Application No. 202227023922 (and English translation).
Office Action dated Oct. 4, 2022 issued in corresponding JP Patent Application No. 2021-553602 (and English machine translation).
Office Action dated Feb. 8, 2023 issued in corresponding CN Patent Application No. 202080074666.5 (and English machine translation).
International Search Report dated Jan. 28, 2020, issued in corresponding International Patent Application No. PCT/JP2019/042324 (and English Machine Translation).
International Search Report dated Dec. 28, 2020, issued in corresponding International Patent Application No. PCT/JP2020/040099 (and English Machine Translation).

* cited by examiner

OUTDOOR UNIT OF AIR CONDITIONING APPARATUS

CROSS REFERENCE TO RELATED APPLICATION

This application is a U.S. National Stage Application of International Patent Application No. PCT/JP2020/040099, filed on Oct. 26, 2020, that claims priority from PCT/JP2019/042324 filed on Oct. 29, 2019, the contents of which are incorporated herein by reference.

TECHNICAL FIELD

The present disclosure relates to an outdoor unit of an air-conditioning apparatus, which includes a bell mouth.

BACKGROUND

Patent Literature 1 discloses a top-flow outdoor unit of an air-conditioning apparatus. The outdoor unit includes a bell mouth provided around an axial fan. The bell mouth is provided on the upstream side in a main airflow of air, and has an inclined wall portion whose pipe diameter decreases from the upstream side toward the downstream side in the main airflow of air. The inclined wall portion of the bell mouth is formed in such a manner as to reduce the load on the axial fan. For example, the bell mouth is formed such that the inclined wall portion is inclined at an angle that falls within the range of 60 degrees to 70 degrees relative to an inlet plane. In addition, the bell mouth is formed such that the ratio of the length of the inclined wall portion to the total length of the bell mouth in the axial direction of the bell mouth falls within the range of 0.33 to 0.42.

PATENT LITERATURE

Patent Literature 1: Japanese Unexamined Patent Application Publication No. 2011-111998

In the case where the bell mouth is formed such that the inclined wall portion is inclined at the above angle and has a length that satisfies the above ratio, the flow rate of air in the axial direction of the bell mouth is increased. At an air outlet in the outdoor unit, an air outlet grille may be provided to prevent, for example, foreign matter from entering the outdoor unit. In the outdoor unit, in the case where the air outlet grille is provided at the air outlet and the flow rate of air in the axial direction of the bell mouth is increased, pressure loss at the air outlet grille is increased. Thus, in Patent Literature 1, a power input to the fan is increased to compensate for the pressure loss at the air outlet grille, and as a result, a fan efficiency may be reduced.

SUMMARY

The present disclosure is applied to solve the above problem, and relates to an outdoor unit of an air-conditioning apparatus, which is capable of reducing pressure loss at an air outlet.

An outdoor unit of an air-conditioning apparatus of an embodiment of the present disclosure includes: a heat exchanger; an axial fan configured to generate a flow of air to be guided into the heat exchanger; a housing having an opening through which the air passes, and housing the heat exchanger and housing the axial fan in a region located between the opening and the heat exchanger; and a bell mouth having an annular shape, provided in the housing and around the axial fan, and configured to guide the air to the opening. The bell mouth includes a first tapered portion formed such that an inside diameter of part of the first tapered portion which is located on an upstream side of the first tapered portion and into which the air flows is larger than an inside diameter of part of the first tapered portion which is located on a downstream side of the first tapered portion, and a straight pipe portion linearly extending from the first tapered portion toward a downstream side. The first tapered portion further includes: a first bent portion forming an inlet for the air; a second bent portion continuous with the straight pipe portion, the second bent portion having an inside diameter smaller than an inside diameter of the first bent portion; and a linking portion continuous with the first bent portion and the second bent portion, the linking portion having an inner surface extending linearly. The inner surface of the linking portion is inclined at 33 degrees or more relative to a direction along an axis of the straight pipe portion. In the direction along the axis of the straight pipe portion, a ratio of a sum of a first length of the first tapered portion and a second length of the straight pipe portion to a total length of the bell mouth is less than 0.76.

Because of provision of the configuration of the embodiment of the present disclosure, it is possible to reduce the airflow in the axial direction of the bell mouth, and reduce pressure loss at an air outlet and a power input to the fan. It is therefore possible to provide an outdoor unit of an air-conditioning apparatus, which is capable of reducing lowering of a fan efficiency.

DETAILED DESCRIPTION

Embodiment

Figure 1:
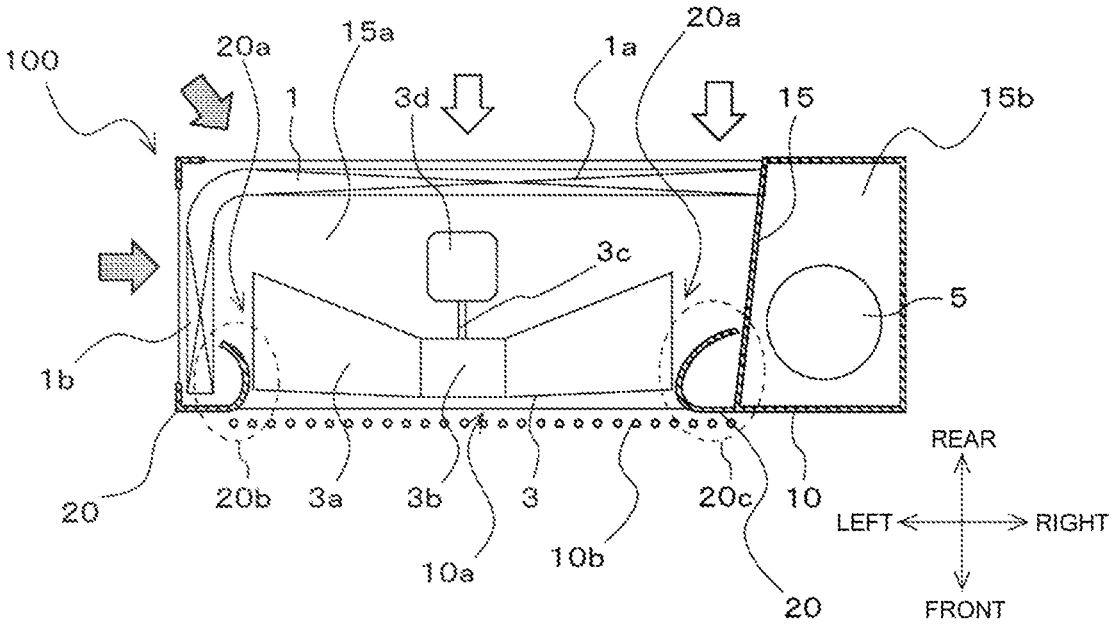
FIG. 1 is a top view schematically illustrating an example of the internal structure of an outdoor unit of an air-conditioning apparatus according to an embodiment of the present disclosure.

A configuration of an outdoor unit 100 for an air-conditioning apparatus according to an embodiment will be described. FIG. 1 is a top view schematically illustrating an example of an internal configuration of an outdoor unit 100 of an air-conditioning apparatus according to the embodiment. FIG. 1 illustrates a side-flow outdoor unit 100 an example of the outdoor unit 100. In addition, in FIG. 1, a flow direction of air that flows as a main air flow into the outdoor unit 100 when the outdoor unit 100 is driven is indicated by outlined arrows, and flow directions of air that flows into the outdoor unit 100 such that the flow directions differ from the flow direction of the above main air flow are indicated by dot-patterned arrows.

In figures including FIG. 1 that will be referred to below, relationships in size and shape between components of the outdoor unit 100 may differ from those between actual components. In addition, basically, it is assumed that the positional relationships between the components of the outdoor unit 100 in, for example, an up-down direction, a lateral direction, or a front-back direction are those established when the outdoor unit 100 is set in a usable state. In each of the figures including FIG. 1, components or parts that are the same as or similar to those in a previous figure or previous figures are denoted by the same reference signs or their reference sigs are omitted.

The outdoor unit 100 includes a housing 10 that houses a heat exchanger 1, an axial fan 3, and a compressor 5. The housing 10 is formed by combining a plurality of sheet-metal panels, for example. The housing 10 has an opening 10*a* that communicates with the inside of the housing 10. As illustrated in FIG. 1, for example, the opening 10*a* is provided at the front of the housing 10. In addition, at the housing 10, an air outlet grille 10*b* is provided to cover the opening 10*a*. The air outlet grille 10*b* is provided downstream of the axial fan 3. The air outlet grille 10*b* has a plurality of small holes such as slits to prevent foreign matter from entering the outdoor unit 100 and adhering to the axial fan 3 and also a user's hand from coming into contact with the axial fan 3 or other parts, thereby preventing the user's hand from getting injured.

The heat exchanger 1 causes heat exchange to be performed between air that passes through the heat exchanger 1 and refrigerant that flows in the heat exchanger 1. For example, an air-cooled heat exchanger 1, such as a finned tube heat exchanger that includes a plurality of plate-like fins disposed side by side and a plurality of heat transfer tubes extending through the plate-like fins, is used as the heat exchanger 1. Referring to FIG. 1, the heat exchanger 1 is L-shaped as viewed in top view, and has a first portion 1*a* located on a rear side in the housing 10 and a second portion 1*b* located on a left side in the housing 10. It should be noted that the L-shaped heat exchanger 1 is an example of the heat exchanger 1, and the heat exchanger 1 may be formed into another shape.

The axial fan 3 is provided between the heat exchanger 1 and the opening 10*a* provided in the housing 10. For example, a propeller fan is used as the axial fan 3. The axial fan 3 includes a plurality of blades 3*a* that are rotated to generate airflow, a hub 3*b* that supports and rotates the blades 3*a*, a shaft 3*c* that has a distal end joined to the hub 3*b*, and a motor 3*d* that is joined to a proximal end of the shaft 3*c* to rotate the shaft 3*c*. The distal end of the shaft 3*c* of the axial fan 3 is provided to face the opening 10*a*. A three-phase induction motor or a brushless DC motor that is capable of controlling the rotation speed of the shaft 3*c* on the basis of voltage is used as the motor 3*d*.

The compressor 5 compresses sucked low-pressure refrigerant into high-pressure refrigerant and discharges the high-pressure refrigerant. For example, a rotary compressor or a scroll compressor is used as the compressor 5. Although it is not illustrated, the compressor 5 is connected to the heat exchanger 1 by a refrigerant pipe.

Furthermore, a partition plate 15 is provided in the housing 10. The inside of the housing 10 is partitioned into a fan chamber 15*a* and a machine chamber 15*b* by the partition plate 15. The heat exchanger 1 and the axial fan 3 are provided in the fan chamber 15*a*. The compressor 5 is provided in the machine chamber 15*b*. Referring to FIG. 1, the partition plate 15 is formed as a plate-like component having a section formed in the shape of a single straight line, but can be a plate-like component having a section having a different shape. For example, the partition plate 15 may be a plate-like component having a section formed in the shape of one or more curved surfaces, a plate-like component having a section formed in the shape of a combination of a plurality of straight lines, or a plate-like component having both a section formed in the shape of a straight line and a section formed in the shape of a curved line. Furthermore, the partition plate 15 can be omitted, although whether the partition plate 15 can be omitted or not depends on, for example, for what purpose the outdoor unit 100 is used.

The outdoor unit 100 further includes a bell mouth 20 that is housed in the housing 10. The bell mouth 20 is an annular component including an air passage that guides airflow generated by rotation of the axial fan 3 to the opening 10*a*. The bell mouth 20 is connected with the housing 10 at the front of the housing 10, for example, at the periphery of the opening 10*a* provided in a front panel of the housing 10. For example, the bell mouth 20 is integrally formed with the front panel of the housing 10 by plastically deforming sheet metal by press working or other methods. FIG. 1 illustrates an inlet 20*a* of the bell mouth 20, into which air generated by rotation of the axial fan 3 flows. In addition, FIG. 1 illustrates a first section 20*b* and a second section 20*c* of the bell mouth 20. The first section 20*b* of the bell mouth 20 is located between the axial fan 3 and the second portion 1*b* of the heat exchanger 1, and the second section 20*c* of the bell mouth 20 is located between the axial fan 3 and the partition plate 15.

The bell mouth 20 is formed to guide air sucked into the housing 10 to the axial fan 3 and to adjust the angle at which air flows to the blades 3*a*. The axial fan 3 is housed in the housing 10 such that the axial fan 3 is surrounded by the bell mouth 20. To be more specific, the axial fan 3 is surrounded by the bell mouth 20 and part of the axial fan 3 is housed in the bell mouth 20. It is therefore possible to reduce the width of the outdoor unit 100 in a front-back direction. Other parts of the configuration of the bell mouth 20 will be described later.

When the outdoor unit 100 is driven, air that is present outside the outdoor unit 100 is guided into the housing 10, for example, into the fan chamber 15*a*, by rotation of the axial fan 3 and is subjected to heat exchange in the heat exchanger 1. In addition, the air in the outdoor unit 100 that has been subjected to heat exchange in the heat exchanger 1 is discharged by rotation of the axial fan 3 to the outside of the outdoor unit 100 via the bell mouth 20, the opening 10*a* of the housing 10, and the air outlet grille 10*b*.

Figure 2:
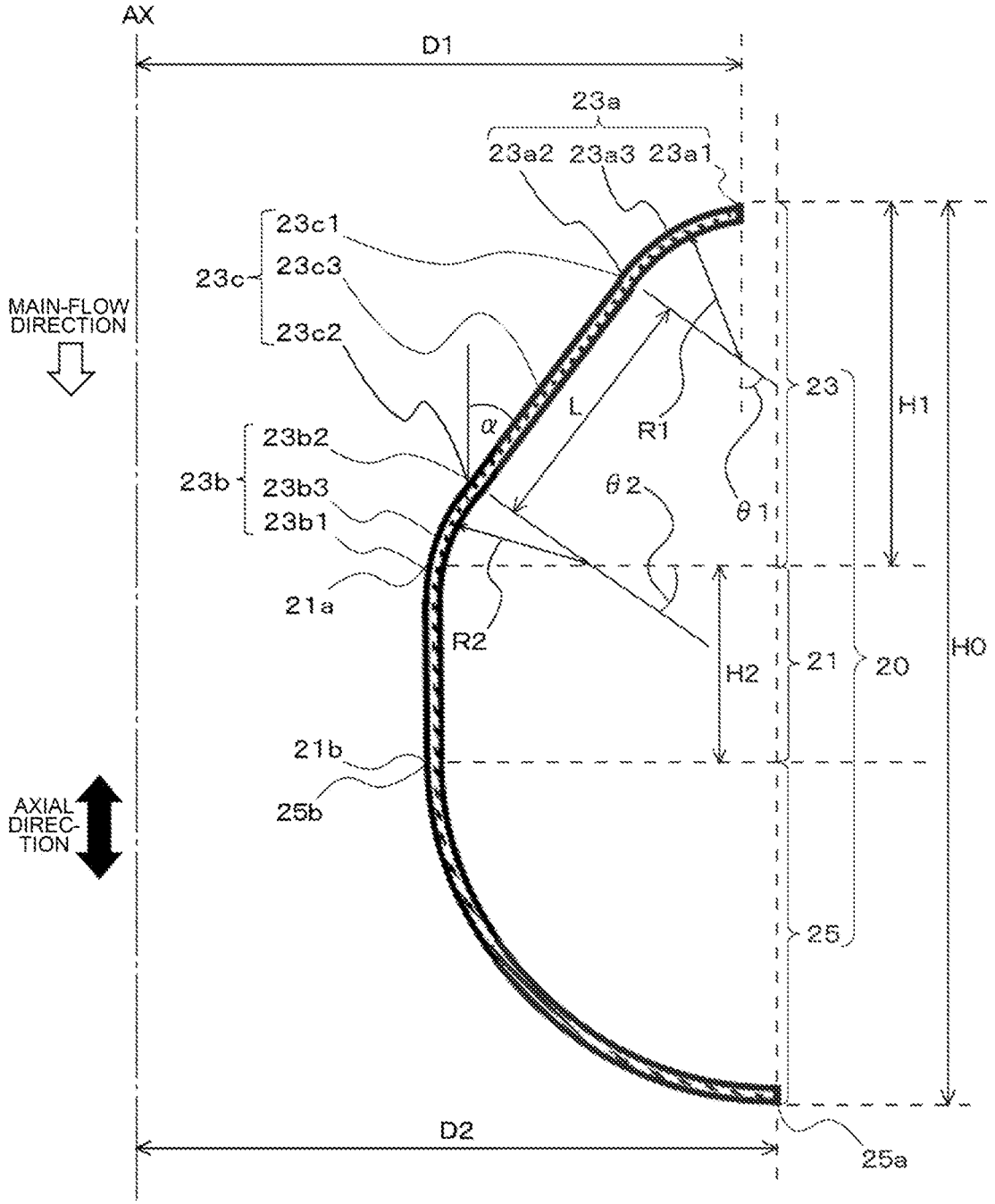
FIG. 2 is an enlarged schematic view of part of a section of a bell mouth as illustrated in FIG. 1.

Next, the configuration of the bell mouth 20 will be described. FIG. 2 is an enlarged schematic view of part of a section of the bell mouth 20 as illustrated in FIG. 1. A section as illustrated in FIG. 2 is a section taken along an axis AX of a straight pipe portion 21, which will be described later. In FIG. 2, the direction along the shaft 3*c* of the axial fan 3 as illustrated in FIG. 1 is indicated by a black double-headed arrow. Also, in FIG. 2, the flow direction of the main airflow is indicated by an outlined arrow as in FIG. 1.

The bell mouth 20 includes the straight pipe portion 21 and a first tapered portion 23 that is continuous with the straight pipe portion 21 on an upstream side in the flow direction of the main airflow.

The straight pipe portion 21 includes end portions 21*a* and 21*b*. The end portion 21*a* is closer to the heat exchanger 1 than the end portion 21*b*, and the end portion 21*b* is closer to the opening 10*a* of the housing 10 than the end portion 21*a*. As illustrated in FIG. 2, an inner surface of the straight pipe portion 21 is linear. The inside diameter of the straight pipe portion 21 from the axis AX indicated by a dash-dot-dash line is constant from the end portion 21*a* to the end portion 21*b*. As illustrated in FIG. 2, the direction in which the axis AX of the straight pipe portion 21 extends is substantially parallel to the flow direction of the main airflow. Furthermore, as illustrated in FIG. 2, the direction along the shaft 3*c* of the axial fan 3 can be determined substantially parallel to the flow direction of the main airflow and the direction in which the axis AX of the straight pipe portion 21 extends. Although it is not illustrated in FIG. 2, the straight pipe portion 21 is provided closer to the peripheries of the blades 3*a* of the axial fan 3 than the other portions of the bell mouth.

The inside diameter of the first tapered portion 23 decreases from the upstream side toward the downstream side in the flow direction of the main airflow. The first tapered portion 23 is provided upstream of the straight pipe portion 21 and downstream of the heat exchanger 1 in the flow direction of the main airflow. To be more specific, the first tapered portion 23 is continuous with the end portion 21*a* of the straight pipe portion 21, that is, one of the end portions thereof that is closer to the heat exchanger 1. The configuration of the first tapered portion 23 will be described later in detail.

In the following description, air that flows along an inner surface of the first tapered portion 23 in the bell mouth 20 is referred to as branch air. In the bell mouth 20, mainly, air that flows in a direction different from the flow direction of the main airflow flows into the first tapered portion 23 and flows as branch airflow.

In addition, the bell mouth 20 also has a second tapered portion 25 that is continuous with the straight pipe portion 21 at a position located between the straight pipe portion 21 and the opening 10*a* of the housing 10, and the inside diameter of the second tapered portion 25 increases in a direction from the straight pipe portion 21 toward the opening 10*a*.

The second tapered portion 25 has end portions 25*b* and 25*a*. The end portion 25*b* is closer to the heat exchanger 1 than the end portion 25*a*, and the end portion 25*a* is closer to the opening 10*a* of the housing 10 than the end portion 25*b*. The inside diameter of the second tapered portion 25 increases in the direction from the end portion 25*b*, which is located on an upstream side in the flow direction of the main airflow, toward the end portion 25*a*, which is located on a downstream side in the flow direction of the main airflow. The second tapered portion 25 is provided downstream of the straight pipe portion 21 and upstream of the opening 10*a* of the housing 10. To be more specific, the end portion 25*b* of the second tapered portion 25 is continuous with the end portion 21*b* of the straight pipe portion 21. In addition, the end portion 25*a* of the second tapered portion 25 is continuous with the housing 10, for example, with an edge of the opening 10*a* formed in the front panel of the housing 10.

Referring to FIG. 2, an inner surface of the second tapered portion 25 is shaped in such a manner as to project toward the inside of the bell mouth 20. However, the shape of the inner surface of the second tapered portion 25 is not limited to such a shape, and may be, for example, a linear shape. In addition, the inner surface of the second tapered portion 25 may have a section shaped by combining a linear section and a section shaped in such a manner as to project toward the inside of the bell mouth 20.

The second tapered portion 25 can be omitted. Whether the second tapered portion 25 is omitted or not depends on, for example, the shape or the size of the outdoor unit 100.

Next, the configuration and the shape of the first tapered portion 23 will be described.

As described above, the inside diameter of the first tapered portion 23 decreases from the upstream side to the downstream side in the flow direction of the main airflow. In at least part of the bell mouth 20 in the circumferential direction, the first tapered portion 23 is formed such that a first length H1 of the first tapered portion 23 in the direction along the axis AX is longer than a second length H2 of the straight pipe portion 21 in the direction along the axis AX. For example, according to the shape of the outdoor unit 100, the first tapered portion 23 may be formed such that at the entire circumference of the first tapered portion 23, the first length H1 of the first tapered portion 23 is longer than the second length H2 of the straight pipe portion 21 in the direction along the axis AX. As described above, the first length H1 of the first tapered portion 23 is longer than the second length H2 of the straight pipe portion 21. This means that the length of a flow passage in the first tapered portion 23 in the flow direction of the main airflow is longer than the length of a flow passage in the straight pipe portion 21 in the flow direction of the main airflow.

In the case where the passage in the straight pipe portion 21 is long, the degree of separation of airflow from the inner surface of the straight pipe portion 21 increases toward the downstream side in the flow direction of the main airflow. Thus, in the case where the passage in the straight pipe portion 21 is long, a vortex or vortexes generated on the upstream side of the straight pipe portion 21 may become larger toward the downstream side. Because of generation of the vortex or vortexes at the straight pipe portion 21, the air passage in the straight pipe portion 21 is substantially narrowed.

When branch air flows to the end portion 21*a* of the straight pipe portion 21, airflow separates from the straight pipe portion 21. As a result, a vortex or vortexes are generated on the upstream side of the straight pipe portion 21. In addition, as the angle between the flow direction of the branch air and the flow direction of the main airflow increases, it is more difficult to cause the flow direction of the branch air to coincide with the flow direction of the main airflow. As a result, the vortex or vortexes generated at the straight pipe portion 21 are enlarged.

However, in the above configuration, the first length H1 of the first tapered portion 23 is greater than the second length H2 of the straight pipe portion 21. Thus, the first tapered portion 23 can have an air passage whose length is sufficient to cause the flow direction of the branch air to coincide with the flow direction of the main airflow. In addition, the ratio of the second length H2 to the first length H1 is low, and it is thus possible to prevent enlargement of the vortex or vortexes generated at the straight pipe portion 21.

Therefore, with the above configuration, the size of the airflow in the first tapered portion 23 can be smoothly reduced, and it is possible to reduce generation of a vortex at the straight pipe portion 21 that is caused by branch air. In addition, even when a vortex is generated at the straight pipe portion 21, it is possible to reduce enlargement of the vortex. As a result, since the configuration is provided as described above, the outdoor unit 100 of the air-conditioning apparatus can reduce the pressure loss at the bell mouth 20.

Furthermore, in the case where the first length H1 of the first tapered portion 23 is greater than the second length H2 of the straight pipe portion 21, in the first tapered portion 23, it is possible to gradually change the flow direction of branch air to cause the flow direction of the branch air to coincide with the flow direction of the main airflow. Thus, it is possible to reduce the load on each of leading edges of the blades 3*a* of the axial fan 3. As a result, in design for the axial fan 3, it is possible to design a configuration that causes the power input to the axial fan 3 to be low. It is therefore possible to achieve power saving of the outdoor unit 100 of the air-conditioning apparatus.

The first tapered portion 23 is formed to have a first bent portion 23*a* and a second bent portion 23*b*. The first bent portion 23*a* forms the inlet 20*a* that allows air to flow into the bell mouth 20, and the second bent portion 23*b* is continuous with the straight pipe portion 21 and has an inside diameter smaller than that of the first bent portion 23*a*. The first bent portion 23*a* and the second bent portion 23*b* are located at respective ends of the first tapered portion 23 in the direction along the axis AX. The first bent portion 23*a* is located upstream of the second bent portion 23*b* in the flow direction of the main airflow. To be more specific, as illustrated in FIG. 2, an end portion 23*a*1 of the first bent portion 23*a*, which is located on an upstream side thereof in the flow direction of the main airflow, forms the inlet 20*a* for air. Furthermore, an end portion 23*b*1 of the second bent portion 23*b*, which is located on a downstream side thereof in the flow direction of the main airflow, is continuous with the end portion 21*a* of the straight pipe portion 21.

The first tapered portion 23 is formed to have the first bent portion 23*a* and the second bent portion 23*b*, whereby the shape or the size of the bell mouth 20 can be optimally determined by individually adjusting the shapes or the sizes of the first bent portion 23*a* and the second bent portion 23*b*. For example, at the first bent portion 23*a*, it is possible to cause branch air to flow into the first tapered portion 23 along the inner surface of the first bent portion 23*a*, and at the second bent portion 23*b*, it is possible to change the flow direction of the branch air to cause the flow direction of the branch air to coincide with the flow direction of the main airflow. In addition, at the second bent portion 23*b*, by causing the flow direction of the branch air to coincide with the flow direction of the main airflow, the branch air can be made to flow along the blades 3*a* of the axial fan 3.

It should be noted that a second opening diameter D2 of the end portion 25*a*, which is located on a downstream side of the second tapered portion 25, can be set larger than a first opening diameter D1 of the end portion 23*a*1, which is located on an upstream side of the first tapered portion 23. The first opening diameter D1 is a distance between the axis AX and the end portion 23*a*1 of the first tapered portion 23 and is half the inside diameter of the first tapered portion 23 at the end portion 23*a*1. The second opening diameter D2 is a distance between the axis AX and the end portion 25*a* of the second tapered portion 25 and is half the inside diameter of the second tapered portion 25 at the end portion 25*a*.

As described above, the bell mouth 20 may be formed integrally with the front panel of the housing 10 by plastically deforming sheet metal by, for example, press working in which a metal mold is used. In such press working using a metal mold, the front panel of the housing 10 is held by a lower die of the metal mold, and the sheet metal is bent in a direction toward the lower die of the metal mold by, for example, bending work to form the bell mouth 20. The second tapered portion 25 is formed closer to the front panel than the other portions. The first tapered portion 23 is formed apart from the front panel. When the second opening diameter D2 is set larger than the first opening diameter D1, it is possible to prevent the end portion 23*a*1 located on the upstream side of the first tapered portion 23 from interfering with the lower die of the metal mold when the front panel of the housing 10 is removed from the lower die of the metal mold. Thus, when the second opening diameter D2 of the end portion 25*a* located downstream of the second tapered portion 25 is set larger than the first opening diameter D1 of the end portion 23*a*1 located upstream of the first tapered portion 23, it is possible to improve the manufacturing efficiency of the bell mouth 20.

In addition, the first tapered portion 23 has a linking portion 23*c* that is continuous with the first bent portion 23*a* and the second bent portion 23*b*. The linking portion 23*c* has an end portion 23*c*1 that is located on an upstream side of the linking portion 23*c* in the flow direction of the main airflow, and an end portion 23*c*2 that is located on a downstream side of the linking portion 23*c* in the flow direction of the main airflow. The end portion 23*c*1 of the linking portion 23*c* is continuous with an end portion 23*a*2 that is located on a downstream side of the first bent portion 23*a* in the flow direction of the main airflow. The end portion 23*c*2 of the linking portion 23*c* is continuous with an end portion 23*b*2 that is located on an upstream side of the second bent portion 23*b* in the flow direction of the main airflow. The inside diameter of the linking portion 23*c* decreases from the end portion 23*c*1 toward the end portion 23*c*2. An inner surface of the linking portion 23*c* has a linear shape and is inclined at an angle $\alpha$ relative to a direction along the axis AX. The angle $\alpha$ is a parameter indicating the degree of opening of the linking portion 23*c*. An air inlet of the bell mouth 20 increases as the angle $\alpha$ increases. At the end portion 23*a*2, the first bent portion 23*a* is inclined at the angle $\alpha$ relative to the direction along the axis AX, and at the end portion 23*b*2, the second bent portion 23*b* is also inclined at the angle $\alpha$ relative to the direction along the axis AX.

Since the first tapered portion 23 has the linking portion 23*c*, branch air that has flowed into the first tapered portion 23 along the inner surface of the first bent portion 23*a* can smoothly flow into the second bent portion 23*b* along the inner surface of the linking portion 23*c*. Thus, since the first tapered portion 23 has the linking portion 23*c*, it is possible to reduce separation of airflow from the first tapered portion 23.

For example, as illustrated in FIG. 2, a section of the first bent portion 23*a*, which extends from the upstream side toward the downstream side in the flow direction of air, can be formed convex toward the inside of the bell mouth 20, that is, can be curved toward the inside of the bell mouth 20 in a radial direction of the bell mouth 20. In addition, a section of the second bent portion 23*b* in the direction along the axis AX has a shape that is convex toward the inside of the bell mouth 20, that is, a shape that is curved toward the inside of the bell mouth 20 in the radial direction.

It should be noted that in accordance with, for example, the internal configuration of the outdoor unit 100, the entire first bent portion 23*a* or part of the first bent portion 23*a* may be formed convex toward the outside of the bell mouth 20, that is, a shape that is curved toward the outside of the bell mouth 20 in the radial direction.

For example, in the second section 20*c* as illustrated in FIG. 1, the first bent portion 23*a* can be curved toward the outside of the bell mouth 20 in the radial direction. In the second section 20*c*, when the first bent portion 23*a* is bent toward the outside of the bell mouth 20 in the radial direction, it is possible to extend, along a surface of the partition plate 15 as illustrated in FIG. 1, part of an inner surface of the bell mouth 20 that is closer to the inlet, and cause air that flows along the partition plate 15 to smoothly flow into the bell mouth 20.

In the following description, a line that indicates the inner surface of the first bent portion 23*a* is referred to as a first edge line 23*a*3. The first edge line 23*a*3 extends from an upstream side of the first bent portion 23*a* where air flows thereinto, toward a downstream side of the first bent portion 23*a*. In addition, a line that indicates an inner surface of the second bent portion 23*b* is referred to as a second edge line 23*b*3. The second edge line 23*b*3 is located on an extension of the first edge line 23*a*3. Furthermore, a line that indicates the inner surface of the linking portion 23*c* extending linearly and that is continuous with the first edge line 23*a*3 and the second edge line 23*b*3 is referred to as a third edge line 23*c*3.

Figure 3:
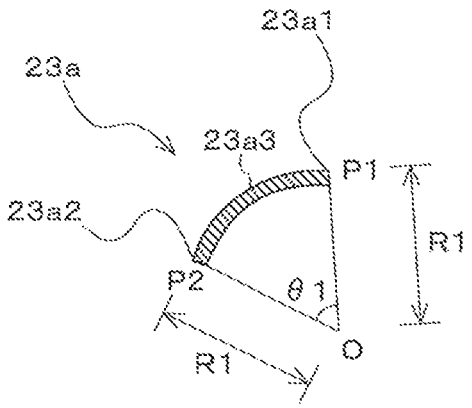
FIG. 3 is a schematic diagram illustrating a relationship between a first curvature radius and a first central angle at a first edge line in the embodiment.

FIG. 3 is a schematic diagram illustrating a relationship between a first curvature radius R1 and a first central angle θ1 at the first edge line 23*a*3 in the embodiment. In FIG. 3, the center of curvature of the first edge line 23*a*3 is represented by a point O, the end portion 23*a*1, which is located at one end of the first bent portion 23*a*, is represented by a point P1, and the end portion 23*a*2, which is located at the other end of the first bent portion 23*a*, is represented by a point P2. A line segment OP1 and a line segment OP2 have the same length and can be determined as the first curvature radius R1 of the first edge line 23*a*3. The first central angle θ1 can be determined as the angle between the line segment OP1 and the line segment OP2, which extend from the point O.

The shape and the size of the first tapered portion 23 can be determined on the basis of a first curvature radius R1 and a first central angle θ1 of the first edge line 23*a*3 and a second curvature radius R2 and a second central angle θ2 of the second edge line 23*b*3. The angle α at which the inner surface of the linking portion 23*c* as illustrated in FIG. 2 is inclined is equal to the second central angle θ2.

For example, as the first curvature radius R1 increases, with the first central angle θ1 fixed, the inclination of the first edge line 23*a*3 becomes gentler. Furthermore, as the first central angle θ1 decreases, with the first curvature radius R1 fixed, the length of the first edge line 23*a*3 decreases. Therefore, it is possible to reduce the size of the first bent portion 23*a*.

The relationship between the second curvature radius R2 and the second central angle θ2 at the second edge line 23*b*3 as illustrated in FIG. 2 is similar to the relationship in FIG. 3 that is described above with reference to FIG. 3. In FIG. 2, the first curvature radius R1 of the first edge line 23*a*3 and the second curvature radius R2 of the second edge line 23*b*3 are indicated by arrows.

That is, as the second curvature radius R2 increases, with the second central angle θ2 fixed, the inclination of the second edge line 23*b*3 becomes gentler. Furthermore, as the second central angle θ2 decreases, with the second curvature radius R2 fixed, the length of the second edge line 23*b*3 decreases. Thus, it is possible to reduce the size of the second bent portion 23*b*.

In addition, the shape and the size of the first tapered portion 23 can be determined on the basis of a length L of the third edge line 23*c*3, which indicates the inner surface of the linking portion 23*c* extending linearly as illustrated in FIG. 2. The width of the linking portion 23*c* in the direction along the shaft 3*c* of the axial fan 3 decreases as the length L decreases. Thus, it is possible to reduce the size of the linking portion 23*c*.

Figure 4:
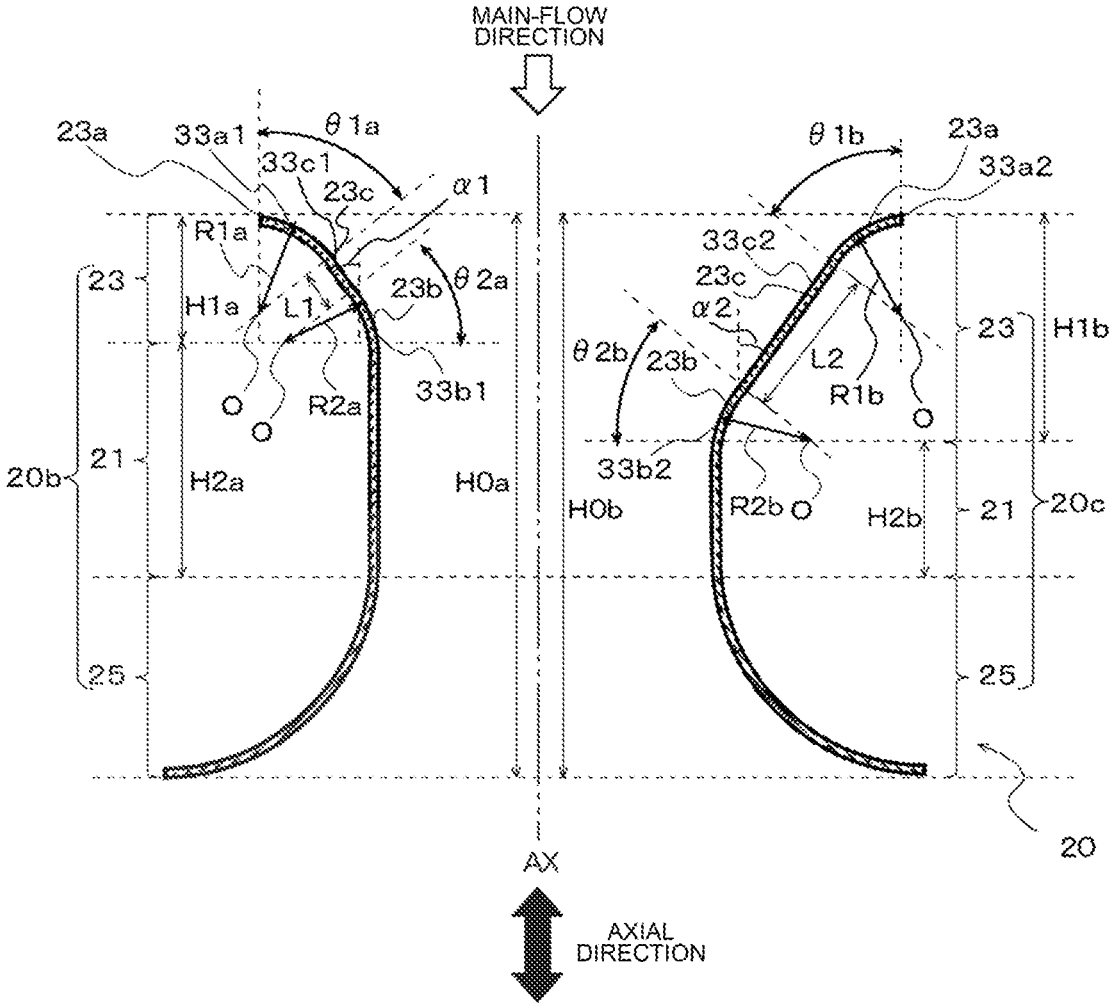
FIG. 4 is an enlarged schematic view of a first section and a second section of the bell mouth as illustrated in FIG. 1.

As illustrated in FIG. 4, the first tapered portion 23 is formed such that the first curvature radius R1 of the first edge line 23*a*3 is greater than the second curvature radius R2 of the second edge line 23*b*3. That is, in the first tapered portion 23, the curvature of the first bent portion 23*a* formed along the first edge line 23*a*3 is smaller than the curvature of the second bent portion 23*b* formed along the second edge line 23*b*3. It should be noted that the curvature is the reciprocal of a curvature radius.

Because of provision of the above configuration, it is possible to cause air to flow along the first edge line 23*a*3 even when the air flows into the first tapered portion 23 in a direction different from the flow direction of the main airflow. In addition, it is possible to cause air that has passed through the first tapered portion 23 to flow along the second edge line 23*b*3 of the second bent portion 23*b* and then flow into the axial fan 3 in the along the shaft 3*c* of the axial fan 3. That is, the bell mouth 20 has the first tapered portion 23 and thus enables air flowing thereinto in a direction different from the flow direction of the main airflow to be guided to the axial fan 3 and to flow into the straight pipe portion 21 in the same direction as the main airflow flows.

In general, an outdoor unit 100 includes an axial fan 3 configured to generate airflow. In the outdoor unit 100, blades 3*a* of the axial fan 3 are disposed in a straight pipe portion 21, whereby the outdoor unit 100 can be made smaller. However, when pressure loss occurs in airflow in the straight pipe portion 21, the air-sending performance of the axial fan 3 deteriorates. Thus, it is necessary to increase electricity consumption of the axial fan 3 in order to compensate for deterioration of the air-sending performance.

On the other hand, in the above configuration of the embodiment, it is possible to reduce generation of a vortex or vortexes that is caused by separation of airflow from the first tapered portion 23 and to reduce the pressure loss of airflow in the straight pipe portion 21. In addition, it is possible to uniformize the distribution of the airflow in the straight pipe portion 21 and to thus reduce deterioration of the air-sending performance of the axial fan 3. Furthermore, even when the blades 3*a* of the axial fan 3 are disposed in the straight pipe portion 21 to reduce the size of the outdoor unit 100, it is not necessary to increase the electricity consumption of the axial fan 3 to maintain the air-sending performance of the axial fan 3. Thus, because of provision of the above configuration, the outdoor unit 100 can be made smaller, and the electricity consumption of the outdoor unit 100 can be reduced.

Furthermore, since the first tapered portion 23 has the linking portion 23*c* having the inner surface extending linearly, it is possible to guide, along the third edge line 23*c*3, airflow that has flowed into the first bent portion 23*a* along the first edge line 23*a*3 of the first bent portion 23*a*. Thus, it is possible to reduce separation of airflow in the first tapered portion 23, from the boundary between the first bent portion 23*a* and the second bent portion 23*b*.

In addition, when the shape of the first tapered portion 23 is changed in a circumferential direction of the first tapered portion 23 with respect to the shaft 3*c* of the axial fan 3, it is possible to further uniformize the distribution of the airflow that flows into the straight pipe portion 21 and to more flexibly reduce the size of the bell mouth 20.

For example, as described above, the shape and the size of the first tapered portion 23 can be determined on the basis of the length L of the third edge line 23*c*3. Thus, when the length L of the third edge line 23*c*3 is changed in the circumferential direction of the first tapered portion 23, it is possible to flexibly determine the shape and the size of the first tapered portion 23. For example, when the length L of the third edge line 23*c*3 is reduced, with the shapes and the sizes of the first bent portion 23*a* and the second bent portion 23*b* unchanged in the circumferential direction, it is possible to reduce the width of the first tapered portion 23 in the radial direction, while reducing separation of the airflow from the first tapered portion 23.

When the outdoor unit 100 is made smaller, the bell mouth 20 provided around the axial fan 3, such as a propeller fan, for use in the outdoor unit 100 of the air-conditioning apparatus may be provided in a small space. However, when the length L of the third edge line 23*c*3 is reduced, with the shapes and the sizes of the first bent portion 23*a* and the second bent portion 23*b* unchanged in the circumferential direction, it is possible to reduce deterioration of the air-sending performance and to reduce the size of the bell mouth 20 even in such a small space.

In addition, the shape and the size of the first tapered portion 23 can be determined on the basis of the first length H1 of the first tapered portion 23 in the direction along the axis AX. When the first length H1 is changed in the circumferential direction of the first tapered portion 23, it is possible to flexibly determine the shape and the size of the first tapered portion 23.

Furthermore, the shape and the size of the first tapered portion 23 can be determined on the basis of the second length H2 of the straight pipe portion 21 in the direction along the axis AX. By changing the second length H2 in the circumferential direction of the straight pipe portion 21, in design, it is possible to flexibly determine the shape and the size of the straight pipe portion 21.

Furthermore, the shape and the size of the first tapered portion 23 can be determined on the basis of at least one of the first curvature radius R1 of the first edge line 23*a*3, the first central angle θ1 of the first edge line 23*a*3, the second curvature radius R2 of the second edge line 23*b*3, and the second central angle θ2 of the second edge line 23*b*3. Thus, by changing at least one of the first curvature radius R1, the first central angle θ1, the second curvature radius R2, and the second central angle θ2 in the circumferential direction of the first tapered portion 23, it is possible to flexibly determine the shape and the size of the first tapered portion 23. As described above, the second central angle θ2 is equal to the angle α of the inner surface of the linking portion 23*c* relative to the axis AX. Thus, the angle α is changed when the second central angle θ2 is changed, and vice versa.

An example in which the shape of the first tapered portion 23 is changed in the circumferential direction around the axis AX will be described by referring to the case where a heat exchanger 1 that is L-shaped as viewed in top view is used as the heat exchanger 1 as in FIG. 1. The following description is made with respect to merely an example, and is not intended to limit the contents of the disclosure.

As described above, the heat exchanger 1 has the first portion 1*a*, which is located on a rear side in the housing 10, and the second portion 1*b*, which is located on a left side in the housing 10. On the rear side in the housing 10, the first portion 1*a* extends in a direction crossing the direction along the shaft 3*c* of the axial fan 3. The second portion 1*b* extends in a direction crossing the first portion 1*a* and is spaced from the first tapered portion 23. The partition plate 15 is provided in the housing 10.

In the outdoor unit 100 having the above configuration, components disposed in the circumferential direction of the bell mouth 20 differ from each other. Thus, when the axial fan 3 is rotated, airflow is generated that flows in a direction different from the flow direction of the main airflow. When air flows into the axial fan 3 in a direction different from the flow direction of the main airflow, the air-sending performance, such as a fan efficiency, may deteriorate, as compared with the case where air flows only in the flow direction of the main airflow.

FIG. 1 illustrates the first section 20*b* of the bell mouth 20, which is located between the second portion 1*b* and the axial fan 3, and the second section 20*c* of the bell mouth 20, which is located between the axial fan 3 and the partition plate 15. Referring to FIG. 1, the second portion 1*b* is located on an extension of an inner surface of the first section 20*b*. Referring to FIG. 2, the second portion 1*b* is not provided on an extension of an inner surface of the second section 20*c*. FIG. 4 is an enlarged schematic view of the first section 20*b* and the second section 20*c* of the bell mouth 20 in FIG. 1.

In the embodiment, the inner surface of the first bent portion 23*a* includes a first upstream region 33*a*1 and a second upstream region 33*a*2. The first upstream region 33*a*1 and the second upstream region 33*a*2 are indicted by first edge lines 23*a*3. The first upstream region 33*a*1 forms part of the inner surface of the first section 20*b*. That is, although it is not illustrated in FIG. 4, the second portion 1*b* as illustrated in FIG. 1 is located on an extension of the first edge line 23*a*3 of the first upstream region 33*a*1. The second upstream region 33*a*2 forms part of the inner surface of the second section 20*c*. That is, although it is not illustrated in FIG. 4, the second portion 1*b* as illustrated in FIG. 1 is not located on an extension of the first edge line 23*a*3 of the second upstream region 33*a*2. In the embodiment, the first edge line 23*a*3 that indicates the first upstream region 33*a*1 is curved convex toward the inside of the bell mouth 20. Referring to FIG. 4, the first edge line 23*a*3 of the second upstream region 33*a*2 is curved convex toward the inside of the bell mouth 20; however, the shape of the first edge line 23*a*3 is not limited to this shape. For example, the first edge line 23*a*3 of the second upstream region 33*a*2 may be curved convex toward the outside of the bell mouth 20.

The inner surface of the second bent portion 23*b* includes a first downstream region 33*b*1 and a second downstream region 33*b*2. The first downstream region 33*b*1 and the second downstream region 33*b*2 are indicated by second edge lines 23*b*3. The second edge line 23*b*3 that indicates the first downstream region 33*b*1 is located on an extension of the first edge line 23*a*3 of the first upstream region 33*a*1. That is, the inner surface of the second bent portion 23*b* in the first section 20*b* as illustrated in FIG. 4 is an example of the first downstream region 33*b*1. The second edge line 23*b*3 that indicates the second downstream region 33*b*2 is located on an extension of the first edge line 23*a*3 of the second upstream region 33*a*2. That is, the inner surface of the second bent portion 23*b* in the second section 20*c* as illustrated in FIG. 4 is an example of the second downstream region 33*b*2. The first downstream region 33*b*1 and the second downstream region 33*b*2 are curved convex toward the inside of the bell mouth 20.

A surface of the linking portion 23*c* indicated by the third edge line 23*c*3 that is continuous with the first edge line 23*a*3 of the first upstream region 33*a*1 and the second edge line 23*b*3 of the first downstream region 33*b*1 at a position located between the first edge line 23*a*3 and the second edge line 23*b*3 will be referred to as a first intermediate region 33*c*1. A surface of the linking portion 23*c* indicated by the third edge line 23*c*3 that is continuous with the first edge line 23*a*3 of the second upstream region 33*a*2 and the second edge line 23*b*3 of the second downstream region 33*b*2 at a position located between the first edge line 23*a*3 and the second edge line 23*b*3 will be referred to as a second intermediate region 33*c*2. That is, in this example, the above surface of the linking portion 23*c* includes the first intermediate region 33*c*1, which includes the third edge line 23*c*3 of the first section 20*b*, and the second intermediate region 33*c*2, which includes the third edge line 23*c*3 of the second section 20*c*.

Part of the first section 20*b* that corresponds to the first tapered portion 23 is a region that guides air that flows thereinto from the second portion 1*b*, and will be referred to as "first guide region". Part of the first section 20*b* that corresponds to the straight pipe portion 21 is a region that is continuous with the first guide region and guides air flowing thereinto from the first guide region, and will be referred to as "second guide region".

In the embodiment, a first central angle θ1*a* of the first edge line 23*a*3, which indicates the first upstream region 33*a*1, can be made to differ from a first central angle θ1*b* of the first edge line 23*a*3, indicates the second upstream region 33*a*2. For example, the first central angle θ1*a* of the first edge line 23*a*3 indicating the first upstream region 33*a*1 can be set smaller than the first central angle θ1*b* of the first edge line 23*a*3 indicating the second upstream region 33*a*2. When the axial fan 3 is rotated, branch air enters the second portion 1*b* in a direction different from the flow direction of the main airflow. When the first central angle θ1*a* of the first edge line 23*a*3 indicating the first upstream region 33*a*1 is reduced, the first edge line 23*a*3 indicating the first upstream region 33*a*1 is shortened. However, when the first curvature radius R1*a* of the first edge line 23*a*3 is kept fixed, branch air can be made to flow along the first edge line 23*a*3 indicating the first upstream region 33*a*1. Thus, it is possible to reduce separation of airflow from the first tapered portion 23. In addition, when the first central angle θ1*a* of the first edge line 23*a*3 indicating the first upstream region 33*a*1 is made smaller than the first central angle θ1*b* of the first edge line 23*a*3 of the second upstream region 33*a*2, it is possible to reduce the width of the first tapered portion 23 in the radial direction. Thus, even when the space between the bell mouth 20 and the heat exchanger 1 is narrow, it is possible to reduce deterioration of the air-sending performance and reduce the size of the bell mouth 20.

The first central angle θ1*a* of the first edge line 23*a*3 indicating the first upstream region 33*a*1 may be changed in the circumferential direction of the first tapered portion 23 as long as the above relationship is satisfied. For example, the first bent portion 23*a* can be formed such that the first central angle θ1*a* of the first edge line 23*a*3 is the greatest possible angle in the first section 20*b*, in which the distance between the second portion 1*b* and the first bent portion 23*a* is the smallest possible distance. In addition, the first central angle θ1*b* of the first edge line 23*a*3 indicating the second upstream region 33*a*2 may be changed in the circumferential direction of the first tapered portion 23 as long as the above relationship is satisfied. Furthermore, the first curvature radius R1 of the first edge line 23*a*3 can be changed in the circumferential direction of the first tapered portion 23.

Furthermore, in the embodiment, a second central angle θ2*a* of the second edge line 23*b*3, which indicates the first downstream region 33*b*1, can be made to differ from a second central angle θ2*b* of the second edge line 23*b*3, which indicates the second downstream region 33*b*2. For example, the second central angle θ2*a* of the second edge line 23*b*3 indicating the first downstream region 33*b*1 can be set greater than the second central angle θ2*b* of the second edge line 23*b*3 indicating the second downstream region 33*b*2. Air that passes through the second portion 1*b* and flows in a direction different from the flow direction of main airflow along the first edge line 23*a*3 of the first upstream region 33*a*1 flows into the straight pipe portion 21 along the second edge line 23*b*3 indicating the first downstream region 33*b*1. In this case, when the second central angle θ2*a* of the second edge line 23*b*3 of the first downstream region 33*b*1 is increased, the second edge line 23*b*3 of the first downstream region 33*b*1 can be lengthened. When the second central angle θ2*a* of the second edge line 23*b*3 of the first downstream region 33*b*1 is increased, air that flows along the second edge line 23*b*3 indicating the first downstream region 33*b*1 can be more reliably made to flow in a direction closer to the direction along the shaft 3*c* of the axial fan 3. Thus, when the second central angle θ2*a* of the second edge line 23*b*3 indicating the first downstream region 33*b*1 is increased, it is possible to further uniformize the distribution of airflow in the straight pipe portion 21. Therefore, it is possible to reduce lowering of the air-sending performance of the axial fan 3. In addition, by reducing the second central angle θ2*b* of the second edge line 23*b*3 indicating the second downstream region 33*b*2, it is possible to reduce the size of the first tapered portion 23. Thus, it is possible to reduce the size of the outdoor unit 100.

The second central angle θ2*a* of the second edge line 23*b*3 indicating the first downstream region 33*b*1 may be changed in the circumferential direction of the first tapered portion 23 as long as the above relationship is satisfied. For example, the second bent portion 23*b* can be formed such that the second central angle θ2*a* of the second edge line 23*b*3 is the greatest possible angle in the first section 20*b*, in which the distance between the second portion 1*b* and the second bent portion 23*b* is the smallest possible distance. In addition, the second central angle θ2*b* of the second edge line 23*b*3 indicating the second downstream region 33*b*2 may be changed in the circumferential direction of the first tapered portion 23 as long as the above relationship is satisfied. Furthermore, the second curvature radius R2 of the second edge line 23*b*3 can be changed in the circumferential direction of the first tapered portion 23.

Furthermore, in the embodiment, a length L1 of the third edge line 23*c*3, which indicates the first intermediate region 33*c*1, can be made to differ from a length L2 of the third edge line 23*c*3 of the second intermediate region 33*c*2. For example, the length L1 of the third edge line 23*c*3 indicating the first intermediate region 33*c*1 can be set shorter than the length L2 of the third edge line 23*c*3 indicating the second intermediate region 33*c*2. When the length L1 of the third edge line 23*c*3 that indicates the first intermediate region 33*c*1 is made shorter than the length L2 of the third edge line 23*c*3 indicating the second intermediate region 33*c*2, it is possible to reduce the size of the first tapered portion 23. Thus, it is possible to reduce the size of the outdoor unit 100. In particular, in the embodiment, by reducing the length L1 of the third edge line 23*c*3 of the first intermediate region 33*c*1, it is possible to narrow the space between the axial fan 3 and the second portion 1*b* of the heat exchanger 1.

Furthermore, when the length L1 of the third edge line 23*c*3 of the first intermediate region 33*c*1 is reduced, with the shapes and the sizes of the first upstream region 33*a*1 and the first downstream region 33*b*1 unchanged, it is possible to reduce the width of the first tapered portion 23 in the radial direction. Thus, even when the space between the heat exchanger 1 and the bell mouth 20 is narrow, it is possible to reduce deterioration of the air-sending performance and to reduce the size of the bell mouth 20.

Furthermore, a first length H1*a* of the first tapered portion 23 in the first section 20*b* in the direction along the axis AX can be made to differ from a first length H1*b* of the first tapered portion 23 in the second section 20*c* in the direction along the axis AX. By causing these values to differ from each other, even when the space between the heat exchanger 1 and the bell mouth 20 is narrow, the size of the bell mouth 20 in the flow direction of the main airflow can be set flexibly. It is therefore possible to reduce the size of the bell mouth 20.

Furthermore, a second length H2*a* of the straight pipe portion 21 in the first section 20*b* in the direction along the axis AX can be made different from a second length H2*b* of the straight pipe portion 21 in the second section 20*c* in the direction along the axis AX. By making the second length H2*a* and the second length H2*b* different from each other, it is possible to flexibly set the size of the bell mouth 20 0 in the flow direction of the main airflow even in the case where the space between the heat exchanger 1 and the bell mouth 20 is narrow. It is therefore possible to flexibly set the size of the bell mouth 20.

Furthermore, the second length H2*a* of the straight pipe portion 21 in the first section 20*b* in the direction along the axis AX can be made longer than the first length H1*a* of the first tapered portion 23 in the first section 20*b* in the direction along the axis AX. That is, a second length H2*a* in the second guide region can be made greater than the first length H1*a* in the first guide region.

The outdoor unit 100 may be made smaller by providing the second portion 1*b* of the heat exchanger 1 such that the second portion 1*b* overlaps with the first section 20*b* of the bell mouth 20 in the direction along the axis AX. In such an outdoor unit 100, for example, when the size of part of the linking portion 23*c* that is located in the first guide region is reduced to reduce the width of the bell mouth 20 in the radial direction, the distance by which the second portion 1*b* of the heat exchanger 1 and the first section 20*b* of the bell mouth 20 overlaps with each other is reduced. As a result, the amount of air that passes through the second portion 1*b* of the heat exchanger 1 and that flows into the first guide region in the radial direction of the bell mouth 20 is increased. Thus, the amount of air that flows into the bell mouth 20 in a radial direction of the bell mouth 20 is nonuniform. Thus, the air-sending performance of the axial fan 3 may deteriorate.

However, when the second length H2*a* in the second guide region is made greater than the first length H1*a* in the first guide region, it is possible to reduce a decrease in the distance by which the second portion 1*b* of the heat exchanger 1 and the first section 20*b* of the bell mouth 20 overlaps with each other. Thus, by making the second length H2*a* in the second guide region greater than the first length H1*a* in the first guide region, it is possible to maintain the uniformity of the amount of air that flows into the bell mouth 20 in radial directions of the bell mouth 20 and to reduce deterioration of the air-sending performance of the axial fan 3.

Furthermore, in the embodiment, by setting the angle α of inclination of the inner surface of the linking portion 23*c* to 33 degrees or more, it is possible to reduce the pressure loss at the air outlet grille 10*b*. In addition, when a ratio ε1 of the sum of the first length H1 of the first tapered portion 23 and the second length H2 of the straight pipe portion 21 to a total length H0 of the bell mouth 20 is set to less than 0.76, that is, the ratio ε1 that satisfies ε1=(H1+H2)/H0 is set to less than 0.76, it is possible to reduce the pressure loss at the air outlet grille 10*b*. The following description is made with reference to FIGS. 5 to 7, in addition to FIGS. 2 to 4.

Figure 5:
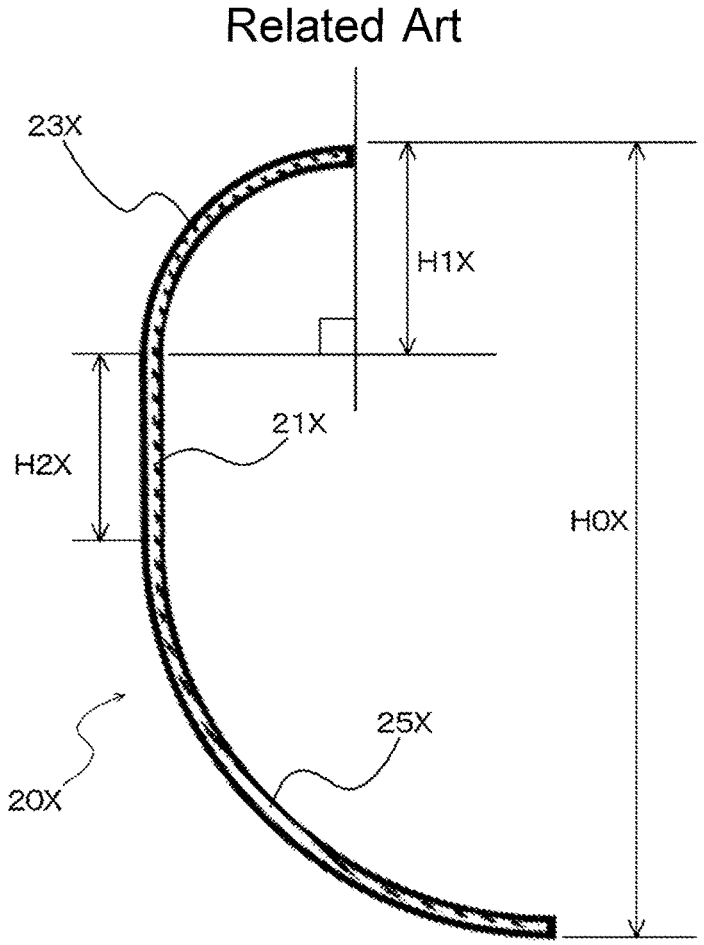
FIG. 5 is an enlarged schematic view of part of a section of a bell mouth of the related art.

FIG. 5 is an enlarged schematic view of part of a section of a bell mouth of the related art. A bell mouth 20X that is the bell mouth of the related art as illustrated in FIG. 5 has a first tapered portion 23X that has a first length H1X in the axial direction, a straight pipe portion 21X that has a second length H2X in the axial direction, and a second tapered portion 25X. The first tapered portion 23X is formed in the shape of an arc whose central angle is 90 degrees. The bell mouth 20X that is the bell mouth of the related art as illustrated in FIG. 5 is formed such that a ratio ε0 of the sum of the first length H1X of the first tapered portion 23X and the second length H2X of the straight pipe portion 21X to a total length H0X of the bell mouth 20X is 0.58, that is, the ratio ε0 that satisfies ε0=(H1X+H2X)/H0X is 0.58. On the above conditions, a fan input value W0 of the axial fan 3 in the bell mouth 20X was measured.

In the bell mouth 20, the angle α of the inclination of the inner surface of the linking portion 23*c* was changed, and a power input value W1 in the outdoor unit 100 was then measured. An input value was evaluated after being normalized with (W1−W0)/W0−1, using the power input value W0, and evaluated. When the input ratio increases in a positive direction, it means that the power input to the fan is deteriorated, and when the input ration increases in a negative direction, it means that the power input is improved.

Figure 6:
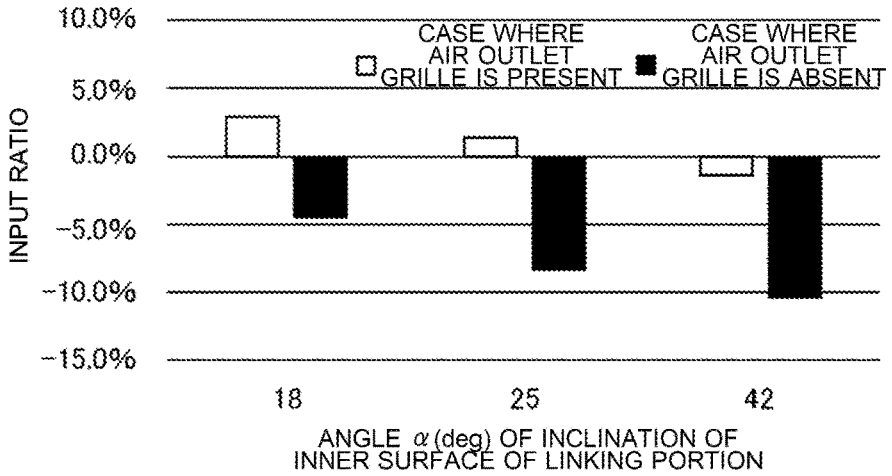
FIG. 6 is a graph illustrating a relationship between a fan input ratio and the angle of inclination of an inner surface of a linking portion.

The results of the above measurement are indicated in FIG. 6. FIG. 6 is a graph illustrating a relationship between a fan input ratio that is a power input ratio for the fan and the angle of inclination of the inner surface of a linking portion. The vertical axis represents the input ratio, and the horizontal axis represents the angle α. Values in the case where the outdoor unit 100 does not include the air outlet grille 10*b* are indicated by black bars, and values in the case where the outdoor unit 100 includes the air outlet grille 10*b* are indicated by white bars.

According to the results of the measurement, in the case where the angle α is 18 degrees and the outdoor unit 100 does not include the air outlet grille 10*b*, the fan input ratio in the outdoor unit 100 is improved, and on the other hand, in the case where the angle α is 18 degrees and the outdoor unit 100 includes the air outlet grille 10*b*, the fan input ratio tends to deteriorate; and in the case where the angle α is 25 degrees, the fan input ratio in the outdoor unit 100 tends to be improved, as compared with the case where the angle α is 18 degrees, and on the other hand, in the case where the angle α is 25 degrees and the outdoor unit 100 includes the air outlet grille 10*b*, the fan input ratio still tends to deteriorate.

In the case where the angle α is 18 degrees, the amount of airflow in the direction along the axis AX that flows into the bell mouth 20 increases. Thus, it is possible to reduce separation of airflow from the leading edges of the blades 3*a* of the axial fan 3 and to reduce the load on the blades 3*a*. On the other hand, when the amount of airflow increases, the amount of airflow that flows out from the bell mouth 20 also increases. Thus, in the case where the outdoor unit 100 includes the air outlet grille 10*b*, pressure loss occurs. Furthermore, in the case where the total amount of airflow in the bell mouth 20 is small, the ratio of the amount of airflow in the radial direction of the bell mouth 20 to the total amount of airflow is high, and the airflow as a whole moves in a direction inclined relative to the direction along the axis AX. Thus, in the case where the angle α is 18 degrees, airflow may collide with the inner surface of the bell mouth 20, and pressure loss may occur.

However, in the case where the angle α is 41 degrees and the outdoor unit 100 includes the air outlet grille 10*b*, the fan input ratio is improved, and the power input to the fan is improved. Therefore, the graph in FIG. 6 indicates that the power input is improved when the angle α is 25 to 42 degrees, that is, it can be said that the power input to the fan is improved when the angle α is 33 degrees or more.

It is found as a problem from the results indicated in FIG. 6 that when the angle α is changed, the total length H0 of the bell mouth 20 is changed. Next, only the first length H1 of the first tapered portion 23 and the second length H2 of the straight pipe portion 21 were changed, with the angle α fixed at an arbitrary value greater than or equal to 30 degrees. The ratio ε1 of the sum of the first length H1 of the first tapered portion 23 and the second length H2 of the straight pipe portion 21 to the total length H0 of the bell mouth 20, that is, the ratio ε1 that is (H1+H2)/H0, was determined, and the input ratio in the ratio ε1 was evaluated. In the measurement, the length of the second tapered portion 25 in the axial direction was fixed. The input ratio was evaluated with a method similar to that in FIG. 6 described above.

Figure 7:
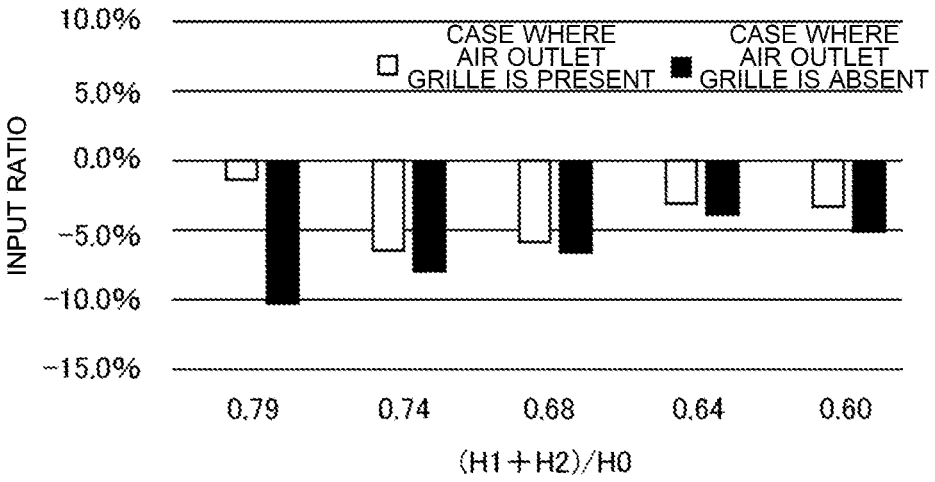
FIG. 7 is a graph illustrating a relationship between a fan input ratio and a ratio regarding the length of the bell mouth.

The results of measurement are indicated in FIG. 7. FIG. 7 is a graph showing a relationship between the fan input ratio and a ratio regarding the length of the bell mouth. The vertical axis represents the input ratio, and the horizontal axis represents the ratio ε1=(H1+H2)/H0. As in FIG. 6, values in the case where the outdoor unit 100 does not include the air outlet grille 10*b* are indicated by black bars, and values in the case where the outdoor unit 100 includes the air outlet grille 10*b* are indicated by white bars.

When the ratio ε1 is 0.79, pressure loss of airflow in the axial direction occurs at the air outlet grille 10*b*, and the input ratio in the case where the outdoor unit 100 includes the air outlet grille 10*b* differs from that in the case where the outdoor unit 100 does not include the air outlet grille 10*b* is shown. When the ratio ε1 decreases from 0.79, the difference between the input ratio in the case in which the outdoor unit 100 includes the air outlet grille 10*b* and that in the case in which the outdoor unit 100 does not include the air outlet grille 10*b* decreases. When the ratio ε1 is less than 0.76, it is possible to reduce, to approximately 2%, the difference between the input ratio in the case where the outdoor unit 100 includes the air outlet grille 10*b* and the input ratio in the case where the outdoor unit 100 does not include the air outlet grille 10*b*.

The total length H0 of the bell mouth 20, the first length H1 of the first tapered portion 23, and the second length H2 of the straight pipe portion 21 may be changed in the circumferential direction as long as the condition that the ratio ε1 is less than 0.76 is satisfied. For example, referring to FIG. 4, a total length H0*a* of part of the bell mouth 20 that is located in the first section 20*b* may be equal to or differ from a total length H0*b* of part of the bell mouth 20 that is located in the second section 20*c*.

In addition, the angle α of inclination of the inner surface of the linking portion 23*c* may be changed in the circumferential direction as long as the condition that the angle α is 33 degrees or more is satisfied. For example, referring to FIG. 4, an angle α1 of inclination of the inner surface of the linking portion 23*c* in the first section 20*b* may be equal to or differ from an angle α2 of inclination of the inner surface of the linking portion 23*c* in the second section 20*c*.

The above embodiment can be variously modified without departing from the gist of the present disclosure. For example, even in the case where the outdoor unit 100 is a chiller unit, the embodiment can be applied thereto in a similar manner to the manner described above. Even in the case where in the air-conditioning apparatus, the outdoor unit 100 and an indoor unit are formed as a single body, the embodiment can be applied thereto in a similar manner to the manner described above.

The invention claimed is:

1. An outdoor unit of an air-conditioning apparatus, the outdoor unit comprising:

a heat exchanger;

an axial fan configured to generate a flow of air to be guided into the heat exchanger;

a housing having an opening through which the air passes, and housing the heat exchanger and housing the axial fan in a region located between the opening and the heat exchanger; and a bell mouth having an annular shape, provided in the housing and around the axial fan, and configured to guide the air to the opening, wherein the bell mouth includes a first tapered portion formed such that an inside diameter of part of the first tapered portion which is located on an upstream side of the first tapered portion and into which the air flows is larger than an inside diameter of part of the first tapered portion which is located on a downstream side of the first tapered portion, and a straight pipe portion linearly extending from the first tapered portion toward a downstream side, the first tapered portion further includes a first bent portion forming an inlet for the air, a second bent portion continuous with the straight pipe portion, the second bent portion having an inside diameter smaller than an inside diameter of the first bent portion, and a linking portion continuous with the first bent portion and the second bent portion, the linking portion having an inner surface extending linearly, the inner surface of the linking portion is inclined at 33 degrees or more relative to a direction along an axis of the straight pipe portion, and in the direction along the axis of the straight pipe portion, a ratio of a sum of a first length of the first tapered portion and a second length of the straight pipe portion to a total length of the bell mouth is less than 0.76.

2. The outdoor unit of the air-conditioning apparatus of claim 1, wherein a first curvature radius of the first bent portion is larger than a second curvature radius of the second bent portion.

3. The outdoor unit of the air-conditioning apparatus of claim 1, wherein at at least part of the bell mouth in a circumferential direction of the bell mouth, the first length is greater than the second length.

4. The outdoor unit of the air-conditioning apparatus of claim 1, wherein a length of the inner surface of the linking portion, which extends linearly, is changed in the circumferential direction of the bell mouth.

5. The outdoor unit of the air-conditioning apparatus of claim 1, wherein the heat exchanger is L-shaped as viewed in top view, the heat exchanger includes a first portion extending in a direction crossing a direction along a shaft of the axial fan, and a second portion extending in a direction crossing the first portion, the second portion being spaced from the first tapered portion, the first tapered portion further includes a first guide region configured to guide air that flows from the second portion into the first guide region, the straight pipe portion includes a second guide region continuous with the first guide region, the second guide region being configured to guide air that flows from the first guide region into the second guide region, and the second length in the second guide region is greater than the first length in the first guide region.

6. The outdoor unit of the air-conditioning apparatus of claim 1, wherein the bell mouth further includes a second tapered portion whose inside diameter increases in a direction from the straight pipe portion toward the opening of the housing, the second tapered portion being continuous with the straight pipe portion and the opening at a position located between the straight pipe portion and the opening, and a second opening diameter of an end portion of the second tapered portion that is located on a downstream side of the second tapered portion is larger than a first opening diameter of an end portion of the first tapered portion that is located on the upstream side of the first tapered portion.

* * * * *